US005775987A

United States Patent [19]

Brinket

[11] Patent Number: 5,775,987

[45] Date of Patent: Jul. 7, 1998

[54] SMOKE REMOVING DEVICE AND METHOD

[76] Inventor: Oscar J. Brinket, 3816 Montego Dr., Huntington Beach, Calif. 92649

[21] Appl. No.: 725,978

[22] Filed: Oct. 4, 1996

Related U.S. Application Data

[63] Continuation-in-part of Ser. No. 349,679, Dec. 5, 1994, Pat. No. 5,562,286.

[51] Int. Cl.[6] ..... B08B 15/04

[52] U.S. Cl. ..... 454/49; 454/341; 454/345

[58] Field of Search ..... 454/49, 230, 232, 454/306, 339, 341, 345

[56] References Cited

U.S. PATENT DOCUMENTS

| | | | |
|---|---|---|---|
| 1,174,065 | 3/1916 | Greising | 454/345 |
| 2,507,634 | 5/1950 | Hill | 454/231 |
| 2,572,120 | 10/1951 | Dixon . | |
| 3,804,942 | 4/1974 | Kato et al. . | |
| 3,807,148 | 4/1974 | Fike et al. . | |
| 3,812,370 | 5/1974 | LaViolette . | |
| 3,890,126 | 6/1975 | Joseph . | |
| 4,043,776 | 8/1977 | Orel . | |
| 4,092,136 | 5/1978 | Zimbardi . | |
| 4,105,015 | 8/1978 | Isom . | |
| 4,119,419 | 10/1978 | Passaro et al. . | |
| 4,161,181 | 7/1979 | Nicks et al. . | |
| 4,177,045 | 12/1979 | Orel . | |
| 4,244,710 | 1/1981 | Burger . | |
| 4,248,162 | 2/1981 | Skeist . | |
| 4,550,738 | 11/1985 | Estey . | |
| 4,580,582 | 4/1986 | Grube et al. . | |
| 4,597,781 | 7/1986 | Spector . | |
| 4,623,367 | 11/1986 | Paulson . | |
| 4,625,633 | 12/1986 | Martin | 454/49 |
| 4,647,295 | 3/1987 | Christ . | |
| 4,671,300 | 6/1987 | Grube et al. . | |
| 4,732,591 | 3/1988 | Tujisawa et al. . | |
| 4,737,173 | 4/1988 | Kudirka et al. . | |
| 4,838,910 | 6/1989 | Stollenwerk et al. . | |
| 4,858,627 | 8/1989 | Netschert . | |
| 4,898,089 | 2/1990 | Roos | 454/49 |
| 4,899,766 | 2/1990 | Ross, Jr. . | |
| 4,911,191 | 3/1990 | Bain . | |
| 4,974,915 | 12/1990 | Bussard | 454/230 X |
| 5,067,394 | 11/1991 | Cavallero . | |
| 5,133,788 | 7/1992 | Backus . | |
| 5,141,539 | 8/1992 | Hiouani . | |
| 5,160,518 | 11/1992 | Vega, Jr. . | |
| 5,181,883 | 1/1993 | Hofstra et al. . | |
| 5,230,720 | 7/1993 | Kendall . | |
| 5,248,323 | 9/1993 | Stevenson . | |
| 5,259,400 | 11/1993 | Bruno et al. . | |
| 5,264,015 | 11/1993 | Matsui . | |
| 5,267,895 | 12/1993 | Mitchell et al. | 454/62 X |
| 5,300,139 | 4/1994 | Lin . | |
| 5,306,207 | 4/1994 | Courts | 454/49 |
| 5,322,473 | 6/1994 | Hofstra et al. | 454/230 X |
| 5,331,886 | 7/1994 | Basel . | |
| 5,342,238 | 8/1994 | Segerpalm et al. . | |
| 5,348,563 | 9/1994 | Davis . | |
| 5,353,814 | 10/1994 | Martin . | |
| 5,417,433 | 5/1995 | Phillips . | |
| 5,441,279 | 8/1995 | Messina . | |
| 5,562,286 | 10/1996 | Brinket . | |

*Primary Examiner*—Harold Joyce
*Attorney, Agent, or Firm*—Price, Gess & Ubell

[57] ABSTRACT

A system of casino tobacco smoke elimination based around a series of slot-like air intakes in which slot length is at least twice as great as slot height. In a preferred embodiment air velocity measured at the slot mouth should be about 1300 feet per minute, and a properly operating slot intake should provide a critical air capture velocity of about 50 feet per minute measured six inches from the slot mouth. A screen is preferably placed over the intake vents to prevent unwanted items from being pulled into the system. The suction system powering the slot-like intakes can end in a fan/filter unit that removes smoke pollutants and returns the cleaned air to the room, or the smoke laden air may be exhausted to the outside by the buildings air conditioning-ventilation system which also provides conditioned fresh air to replace the exhausted smoke. The configuration of the present system may be used in connection with numerous gaming devices, such as gaming tables, slot machines, video bars and nongaming structures such as restaurant booths and bars. When configured for slot machines, the intake vents are placed above and to the sides of the slot machines.

12 Claims, 5 Drawing Sheets

SMOKE REMOVING DEVICE AND METHOD

The present application is a continuation-in-part of application Ser. No. 08/349,679 filed Dec. 5, 1994 which will issue as U.S. Pat. No. 5,562,286.

BACKGROUND OF THE INVENTION

1. Field of the Invention

The present invention relates generally to devices for removing smoke and purifying air and, more particularly, relates to gaming devices having built-in smoke removing and air purifying facilities.

2. Description of Related Art

Gambling casinos are frequented by smokers and, hence, are generally filled with secondhand tobacco smoke. It is now well established that this secondhand smoke presents a significant health hazard. Nonsmokers, in particular, are often reluctant to assume the risk of exposure to secondhand smoke. Accordingly, a problem exists in the prior art of providing gambling casinos which can accommodate smokers and nonsmokers alike.

While many prior art devices exist for removing tobacco smoke and for generally purifying the air. Few of the prior art devices are specifically tailored for use in a gambling casino, and those that are may not operate ideally. In particular, air purification and smoke filtering apparatuses are often bulky, burdensome, and aesthetically unappealing. For example, the Smoke Filtering Apparatus of Hiouani, U.S. Pat. No. 5,141,539; and the Air Purifying Side Table of Kendall, U.S. Pat. No. 5,230,720, are both inappropriate for use in a gambling casino. Either of these two devices, if placed on a gaming table, would consume valuable playing space and/or obstruct a player's vision. Moreover, air purifying devices in the prior art are often difficult to install.

A patent to Messina, U.S. Pat. No. 5,441,279, discloses a system for placing a fan unit within a gaming table to draw off tobacco smoke. A potential problem with this approach is the substantial difficulty in selecting and maintaining proper inlet velocity to effectively remove tobacco smoke from a gaming table. This problem is addressed in the parent application to this application where the present inventor presented a slot intake system particularly adapted for installation in existing gaming tables and which included a configuration of the air intakes especially selected to maintain adequate air velocity. There remains, however, a need for applying efficient smoke evacuating means to other gambling devices such as slot machines.

SUMMARY OF THE INVENTION

The present invention provides a system of casino tobacco smoke elimination based around a series of slot-like air intakes in which slot length is at least twice as great as slot height. Secondhand smoke from a user of a gaming device is drawn into the intakes and purified, thus rendering the air in the gambling casino more acceptable to smokers and nonsmokers alike. In a preferred embodiment air velocity measured at the slot mouth should be about 1300 feet per minute, and a properly operating slot intake should provide a critical air capture velocity of about 50 feet per minute measured six inches from the slot mouth. A screen is preferably placed over the intake vents to prevent unwanted items from being pulled into the system. A prefilter may be placed between the screen and the intake vent to provide a first filtering stage to keep larger particulate matter out of the system. The suction system powering the slot-like intakes can end in a fan/filter unit that removes smoke pollutants and returns the cleaned air to the room, or the smoke laden air may be exhausted to the outside by the buildings air conditioning-ventilation system which also provides conditioned fresh air to replace the exhausted smoke. The configuration of the present invention may be used in connection with numerous gaming devices, such as gaming tables, slot machines, video bars and nongaming structures such as restaurant booths or bars. When configured for slot machines, the intake vents are placed above and to the sides of the slot machines.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DETAILED DESCRIPTION OF THE PREFERRED EMBODIMENTS

Figure 1:
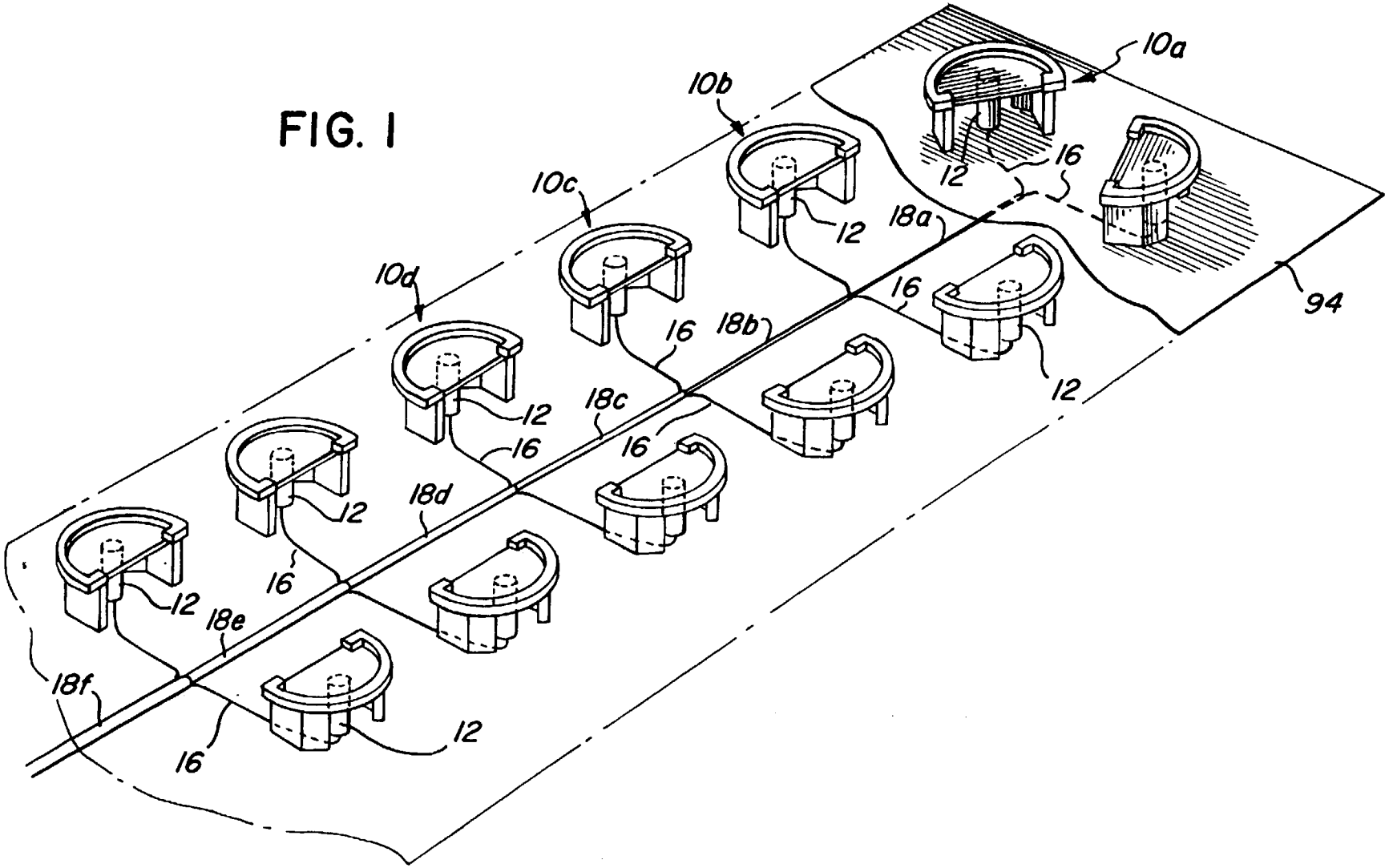
FIG. 1 shows a diagrammatic view of a gambling "pit" containing 12 blackjack tables.

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide apparatus and methods for evacuating tobacco smoke.

A major problem with indoor tobacco smoke pollution is that after emission from a burning source (i.e., a cigarette) or exhalation by a tobacco user, the escaping smoke becomes rapidly dispersed in the indoor atmosphere. This means that to effectively remove dispersed smoke virtually the entire volume of the room's air must be rapidly exchanged for clean, smoke-free air. The clean air may be drawn from outside with attendant energy costs of heating or cooling this huge volume or is simply filtered to remove the pollutants with attendant energy costs and noise; both of these alternatives are ineffective when the entire volume of room air must be replaced. Therefore, it is necessary to reduce the volume of air to be replaced by catching and drawing off the smoke before it has a chance to disperse within the room air. This requires air intakes strategically placed with intake air velocities adequate to ensure smoke removal before dispersal.

The present inventor has made a long series of tests and experiments to establish the ideal conditions for such smoke removal. However, it should be realized that these experiments did not take place in a vacuum, so to speak. The American Society of Heating Refrigerating and Air Conditioning Engineers (ASHRAE) has established a standard entitled "Ventilation for Acceptable Indoor Air Quality" (ASHRAE Standard 62-1989). This widely-accepted standard provides guidelines for design of ventilation systems of buildings, and the guidelines within ASHRAE Standard 62 have been adopted as statutory requirements by agencies and in building codes, both in the United States and worldwide.

The current Standard 62 recommends providing a minimum of 30 cubic feet per minute (cfm) per occupant in casinos and similar indoor environments. This is approximately twice the rate recommended for most offices and dwelling places. These higher ventilation rates, which are legally binding in most U.S. jurisdictions, represent recognition that activities in casinos produce far more air contamination than ordinary office or home activities. ASHRAE Standard 62 assumes a worst case scenario occupation rate of 120 people per 1000 square feet in a casino. This translates to 8.33 square foot per person which is remarkably close to the maximum loading of one person per 7 square feet established in the Uniform Building Code. Any attempts to deal with indoor tobacco smoke removal must be cognizant of an compatible with ASHRAE Standard 62.

The above standard translates to an air replacement rate of 3.6 cfm per square foot (30 cfm per person per 8.33 square feet=30/8.33=3.6 cfm per square foot) which is truly a large volume of air to be replaced. This also means that 3.6 cfm per square foot must be exhausted before the replacement air can be added. As already mentioned, the ideal arrangement is to withdraw the bulk of this air from highly polluted areas (i.e., near a burning cigarette) so that the smoke can be removed before it disperses. Because ASHRAE Standard 62 is aimed at removing carbon dioxide as well as other pollutants, it is preferred to exhaust the polluted air to the outside because usual air purifying and filtering systems do not effectively remove carbon dioxide from the filtered air. Thus, if the smoke laden air is merely filtered, its load of carbon dioxide is re-released into the room. However, in the case of pre-existing casinos there is little option other than to filter out the smoke and allow the building air conditioning-ventilation system deal with the extra carbon dioxide through addition of outside air.

The air ventilation rates recommended in ASHRAE Standard 62 are determined, in part, by the amount of air required to dilute contaminants to an acceptable level. If the most highly contaminated air can be collected near the source of contamination, before dispersing into the room air, the amount of air required for dilution will decrease. ASHRAE Standard 62 makes some provision for this in allowing the actual ventilation rate to be determined by measuring the actual air quality and increasing or decreasing the ventilation rate as required. Carbon dioxide concentration has been widely used as an indicator of indoor air quality used for determining ventilation rate. Future revisions of ASHRAE Standard 62 are expected to focus more on the measured quality of indoor air so that energy wasting prescriptive ventilation can be reduced as much as possible. Use of air intakes that "catch" the tobacco smoke before it mixes with the bulk of the room air will be particularly advantageous with ventilation standards based on actual measured air quality.

Within the framework of ASHRAE Standard 62 the design of a smoke removal system for a particular casino depends greatly upon the arrangement of the building ventilation system. In order to capture the contaminated air one must produce "air capture" velocities near the contamination source adequate to overcome air movement caused by the ASHRAE Standard 62 mandated building air conditioning system, air disturbances caused by the movement of people, and the natural tendency of warm tobacco smoke to rise within the cooler, denser surrounding air. However, if the "air capture" velocity is too high, local air turbulence will significantly reduce capture efficiency and some or all of the contaminated air will escape. Furthermore, excessive air velocity may result in objectionable noise or uncomfortably drafty conditions. Thus, the ideal air capture velocity must be selected to compromise between conflicting requirements.

The present inventor has applied principles of industrial ventilation, generally used to exhaust noxious fumes in industrial processes, to the problems of indoor tobacco smoke reduction. An example is the smoke-removing gaming table previously disclosed. In that device slot-like air intakes are located about the periphery of the table by raising the table rim by approximately 1½-inches. This creates a peripheral slot-like air intake which is roughly analogous to those used in industry to control migration of corrosive fumes from acid electroplating baths. A priori it is virtually impossible to know what the ideal "air capture" velocity should be. Extensive experiments have come to the surprising conclusion that the range of acceptable "air capture" velocities is unexpectedly narrow. A velocity of about 50 feet per minute (fpm) is measured at a distance of 6 inches from the slot captures virtually all smoke within a radius of about 12 inches. At distances farther than 12 inches a decreasing amount of smoke is captured-less as the smoke source moves farther away although most smoke within a 24 inch radius is effectively captured. This means that virtually all smoke from cigarettes held near the table rim and much of the smoke exhaled over the table by the players is effectively captured. Velocities significantly lower than 50 fpm (at six inches from the slot) are noticeably less effective at capturing smoke because these lower velocities are unable to overcome convection currents and room air currents. "Air capture" velocities below about 25 fpm are virtually unable to clear appreciable amounts of smoke from above the table. Velocities significantly higher than about 100 fpm result in significant noise and counterproductive turbulence as well as consuming more energy in just moving the air.

On the usual blackjack table the slot is nearly 12 feet long, which necessitates a rather large volume of air be taken in to ensure the desired 50 fpm capture velocity. In a preferred embodiment the slot 12 foot slot is served by seven equally spaced air intakes, each having an opening of approximately eight inches by one inch with each intake capturing around 110 cfm at a six-inch air capture velocity of 50 fpm. The air from each intake is drawn through transition fittings to a rectangular duct having an area at least as large as, and preferably very close to, that of the intake. The duct is connected to a fan/filter box if the air is to be discharged back into the room. If the contaminated air is to be exhausted outside, the table is connected to a casino-wide central air conditioning-ventilation system. In either case the table must be capable of exhausting at least about 750 cfm of air.

Proper air flow at each intake and through the system is important. Poor airflow causes increased system turbulence which results in increased noise and system energy consumption. The preferred design accelerates the air gradually from the collection intakes, through ducts and transition fittings and other components to minimize air turbulence. The area of the intake opening must match the area of the duct to avoid turbulence. As ducts leading to several intakes connect together, the overall area of the resulting duct must be increased accordingly. If a fan/filter is used, all fan/filter components must be designed to maximize system efficiency. Ideally, contaminated air would be exhausted outside to comply with ASHRAE Standard 62. However, it is often difficult to retrofit such an outside exhaust system to an existing casino without completely replacing the casino's air conditioning-ventilation system. In such a case filtering the contaminated air to remove smoke is a necessity. Even the filtering process is, of necessity, a compromise. A filter that would remove all particles and aerosols seems ideal, but such a filter would tend to be so dense that a prohibitive amount of energy (resulting in a prohibitive level of noise) would be required to filter the air and provide the desired collection velocity of about 50 fpm. Further, the fans needed would generally be too large to fit beneath the table. Currently, a HEPA-type filter seems to be the best compromise between efficiency of pollutant removal and filter density.

Continued experimentation has allowed the inventor to produce a standardized slot intake configuration that is adaptable to a large number of indoor air pollution problems. Because the experiments have shown that it is critical to deliver the optimal "air capture velocity" at the intake, it is desirable to specify a limited number of configurations that are certain to readily meet the air capture velocity requirements, as well as other requirements of a functional air purification system. Further, the standardized components lend themselves to either a fan/filter or a central building purification system.

Table 1 illustrates the experiments that lead to the currently preferred configurations and air velocities. In the illustrated experiment a duct of 2 inches by 5 inches (10 square inches) was provided. The actual slot intake was 1.25 inches by 8 inches (10 square inches). The effective intake area was actually about 25% smaller than this because the intake was covered by a 76% open mesh. It is important to take the coverage area of intake screens or meshes into account when configuring systems based on the present invention. In the experiment electrical power to a fan/filter unit was varied to achieve various target volumes of air. This process necessarily altered the air velocity measured directly at the intake. As the table shows, when intake volume varied from 30 cfm to 140 cfm, intake air velocity varied from around 400 fpm to about 2,000 fpm (a five fold variation). The critical 6-inch capture velocity varied from about 25 to about 115 fpm (slightly less than a five-fold variation). Effective smoke removal occurred between about 40 fpm and about 105 fpm with a range of about 50 to about 100 fpm being the best. Within this range one would select the lowest velocity that gives adequate smoke clearance in a particular configuration (less noise and less energy usage).

| Velocity (fpm) at Intake | Velocity (fpm) at 6 inches | Intake Air Volume (cfm) |
|---|---|---|
| 430 | 25 | 30 |
| 576 | 33 | 40 |
| 720 | 41 | 50 |
| 864 | 50 | 60 |
| 1008 | 58 | 70 |
| 1152 | 66 | 80 |
| 1296 | 75 | 90 |
| 1440 | 82 | 100 |
| 1584 | 91 | 110 |

-continued

| Velocity (fpm) at Intake | Velocity (fpm) at 6 inches | Intake Air Volume (cfm) |
|---|---|---|
| 1728 | 99 | 120 |
| 1872 | 107 | 130 |
| 2020 | 115 | 140 |

The desired air capture velocity of about 50 fpm is met with a 10-square-inch slot intake operating with an air velocity at the intake of about 1300 fpm. A proper slot must have a slot length at least about twice as great as slot height to assure proper flow characteristics. The desired air capture velocity (about 50 cfm at six inches) is readily achieved when the intake is a five inch by two inch (10 square inches) or a ten-inch by one-inch (10 square inches) slot. Other slot proportions between these two values yielding 10 square inches will necessarily also satisfy the required velocity conditions. Proportions outside of this range may require adjustment of other system parameters to achieve acceptable capture velocities. It has been found that an "ideal" slot intake should have an intake air velocity (measured directly at the slot) of between 1000 and 2000 fpm, more preferably between about 800 and 1500 fpm. The air evacuator (fan/filter or central air condition-ventilation system) and the ducts or conduits connecting is selected and sized to produce intake velocity in the desired range for the particular air intake area. If the slot geometry (length versus height) is in the proper range, air velocity at six inches will also fall into the desired range (around 50 fpm). When the components are all assembled, the system can be "tuned" by altering evacuator power or altering restrictions or bleeds in the conduit to optimize the six-inch velocity. However, if the system is properly specified according to the present invention only slight adjustments should be necessary.

Table 2 lists the overall system measurements for these intake configurations in a number of different situations. In all cases the slot air intakes are covered by a grille or screen to prevent large object from being drawn into the ventilation system. In addition, it may be advantageous to mount a "prefilter," for example, a fiber glass air filter, behind the grille or screen to limit the amount of dust and large particulate matter that contaminates the ventilation system. An important point to note is that all of the configurations produce identical intake velocities and are specified with filter areas selected to produce uniform filter velocities. The use of uniform filter velocities makes it simpler to ensure that noise and other performance factors are comparable from installation to installation. The maximum total cubic feet per minute per item (approximately 1200 cfm) is a capacity readily provided by available fan units that comfortably fit within the listed item. That is, where a 20-foot video bar is to be smoke purified, a 1200 cfm fan unit can be readily accommodated within the bulk of the bar. Also, because of standardization of intakes it is relatively easy to specify the capacity of a central air system intended to service the units in place of a fan/filter. The systems displayed in Table 2 all use a 10-square-inch intake that produces air capture velocities at six inches near the ideal (50 fpm) when intake velocity is about 1300 fpm.

TABLE 2

| Item | Intake Size (w × h) | Intake Area | Intake Flow | Intake Velocity (ft./min.) | Intake Number | Total Flow | Max. Filter Velocity (ft./min.) | Minimum Filter Area (sq. ft.) |
|---|---|---|---|---|---|---|---|---|
| Blackjack Table | 5" × 2" | 10 sq. in. | 90 cfm | 1296 | 7 | 630 | 250 | 2.5 |
| Poker Table (8 person) | 5" × 2" | 10 sq. in. | 90 cfm | 1296 | 8 | 720 | 250 | 2.9 |
| Poker Table (10 person) | 5" × 2" | 10 sq. in. | 90 cfm | 1296 | 10 | 900 | 250 | 3.9 |
| Roulette Table | 5" × 2" | 10 sq. in. | 90 cfm | 1296 | 7 | 630 | 250 | 2.5 |
| Crap Table | 5" × 2" | 10 sq. in. | 90 cfm | 1296 | 10 | 900 | 250 | 3.6 |
| Slot Machine Group (8 units) | 10" × 1" | 10 sq. in. | 90 cfm | 1296 | 9 | 810 | 250 | 3.2 |
| Slot Machine Group (12 units) | 10" × 1" | 10 sq. in. | 90 cfm | 1296 | 13 | 1170 | 250 | 4.7 |
| Video Machine Group (12 units) | 10" × 1" | 10 sq. in. | 90 cfm | 1296 | 13 | 1170 | 250 | 4.7 |
| Video Bar (10 ft.) | 5" × 2" | 10 sq. in. | 90 cfm | 1296 | 8 | 720 | 250 | 2.9 |
| Video Bar (20 ft.) | 5" × 2" | 10 sq. in. | 90 cfm | 1296 | 13 | 1170 | 250 | 4.7 |
| Gambling Pit (12 BJ tables) | | 10 sq. in. | 90 cfm | 1296 | 84 | 7560 | 250 | 30 |
| Restaurant Booth Group (4 units) | | 10 sq. in. | 90 cfm | 1296 | 12 | 1080 | 250 | 4.3 |

The present inventor has determined from extensive experimentation and calculation that slot air intakes of the listed sizes when operated at the listed intake velocity (i.e., about 1300 cfm) will yield an "air capture" velocity of about 50 cfm at six inches from the intake, a velocity that effectively removes virtually all tobacco smoke from a 12 inch radius about the intake and a vast majority of smoke from a 24 inch radius. By correctly positioning the slot intakes around an article of gambling equipment smokers using that equipment will contribute very little tobacco smoke pollution to the ambient air in the casino. This means that it will be much easier for the air conditioning system to meet ASHRAE Standard 62, especially when the performance versions of this standard are adopted.

Most of the items in Table 2 can be configured as either a fan/filter unit or be designed to operate from a custom central purification unit that forms part of the building air conditioning-ventilation system. That is, the slot air intakes and the operating parameters have been selected so that available fan units and filters can meet the specifications and still fit comfortably within the item. Note that the minimum filter area are all quite small so that the filter can be compact and so that the total flow volumes can be generally met by a readily available 1500 cfm fan unit. This does not apply to the "Gambling Pit" which represents a pit-like arrangement of 12 blackjack tables. The flow requirements of any one table is similar to those shown in Table 2 for a single blackjack table. Thus, the overall assemblage of 12 tables has a tremendous air flow requirement of over 7,000 cfm. Clearly, a filter of this large a capacity cannot fit within a single blackjack table nor is there a convenient place for such a filter within the "pit."

This "pit" is intended to illustrate the scalability of the present invention and its application to specialized central air conditioning-ventilation systems that provide the required suction power to exhaust the tobacco smoke laden air to the outside. FIG. 1 shows a diagrammatic view of such a "pit." Each of twelve blackjack tables 10 is connected, through one of its legs 12, to duct work 14 hidden underneath a floor 94 and arranged in a "tree" configuration. The tables are designed according to the specifications of Table 2 to have a per table air intake of about 600 cfm. To maintain the calculated flow rate without excessive duct noise and without placing an excessive load on the air conditioning-ventilation system it is important to graduate the diameter of the duct work 14. Branch ducts 16 leading from each table 10 to a "trunk" duct 18 are about 10 inches in diameter. A 12 inch diameter section of trunk duct 18*a* leads from the last tables 10*a* in the chain to the penultimate tables 10*b*. An 18 inch diameter trunk section 18*b* leads to the next lower tables 10*c*; a 20 inch diameter trunk section 18*c* leads to the next lower tables 10*d*. The next lower trunk section 18*e* has a diameter of 22 inches while the lowest trunk section 18*f* has a diameter of 24 inches. A final run of trunk duct work 18*g* has a diameter of 27 inches and supports a total flow of 7200 cfm at a velocity of 1900 fpm. While it may seem that the final trunk duct 18*g* is excessively large at 27 inches diameter, smaller ducts would lead to excessive air velocity and noise with concomitant energy losses.

Figure 2:
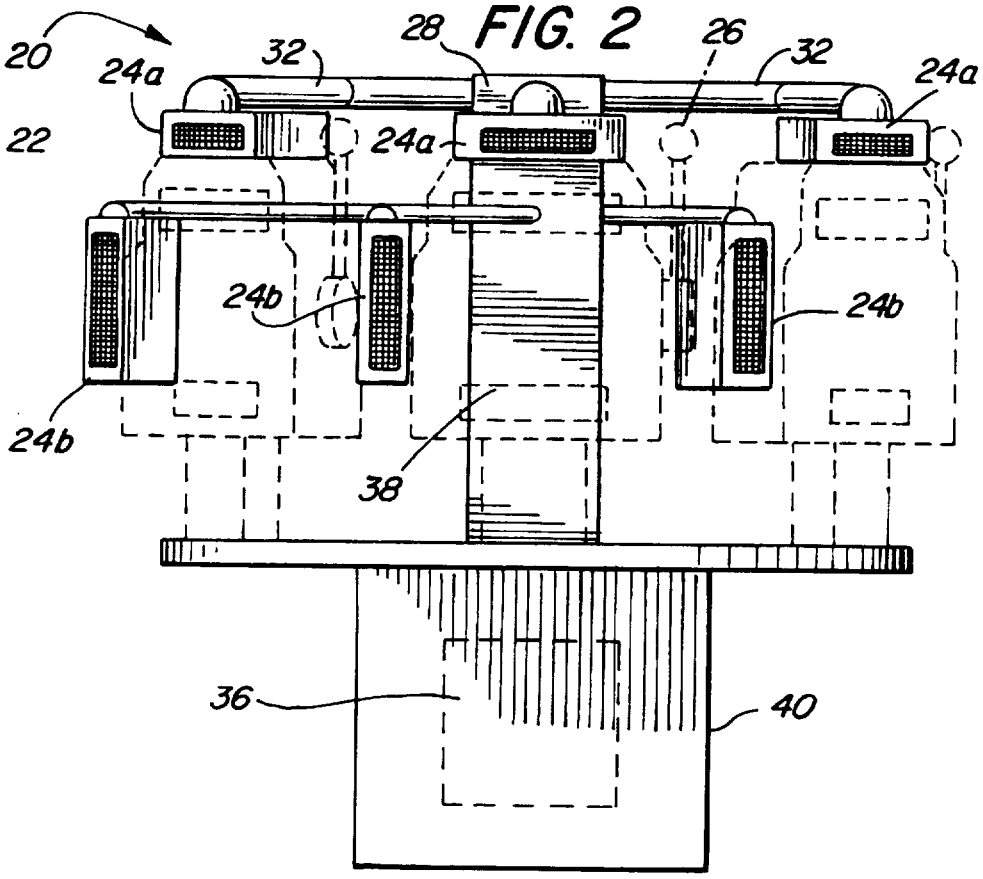
FIG. 2 shows an elevational view of an eight unit slot machine group.
Figure 3:
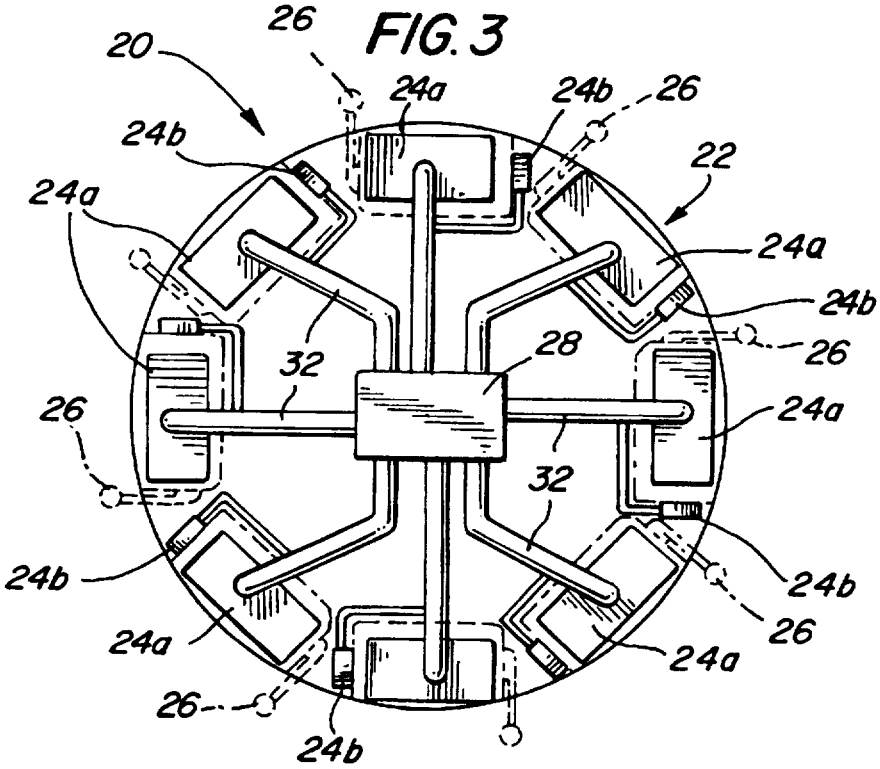
FIG. 3 shows a view of the group of FIG. 2 from above.

FIG. 2 shows a elevational view of a circular group 20 of slot machines 22, here arranged to contain eight slot machines 22. Here each slot machine has two slot intakes 24 (10 inches×1 inch as specified in Table 2), an upper intake 24*a* above the machine 22 and a side intake 24*b* on the side away from a play lever 26. Recall that the air intakes are designed to remove virtually all smoke within a 12 inch radius and most smoke within a 24 inch radius. Since the machines 22 are approximately 24 inches wide, the side intakes 24*b* will capture virtually all smoke from a cigarette held in the player's left hand (since the play lever 26 is on the right side, players generally hold their cigarettes with their left hands, or with the modem button-operated machines hold their cigarettes in their left hand as they push the button). The upper intake 24*a* will capture smoke escaping from the player's mouth and because the machines 22 are circularly arranged (see FIG. 3), the side intake 24*a* of the machine 22 to the right (i.e., counterclockwise in FIG. 3) serves to scavenge any smoke escaping to the right when players hold cigarettes with their right hands. The upper ducts 24*a* are attached to a plenum 28 by duct work 32 which has a cross-sectional area of about 20 square inches (i.e., sufficient area to handle two intakes). The side intakes 24*b* are attached by duct work 34 (cross-sectional area of 10 square inches) to duct work 32. The plenum 28 is connected to either a fan/filter 36 concealed within a group pedestal 40 or to the central air conditioning system by a master duct 38 with a cross-sectional are of about 160 square inches.

Figure 4:
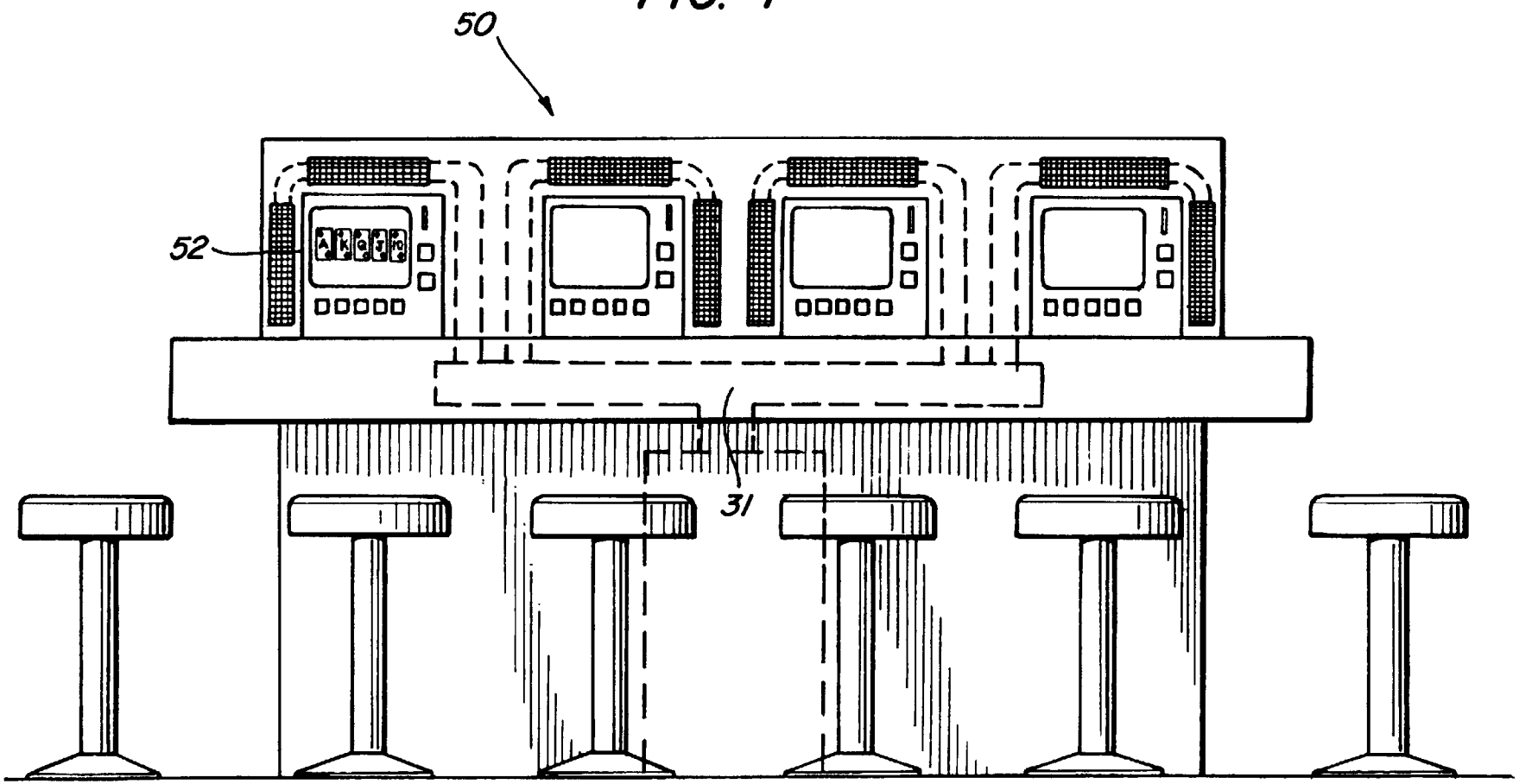
FIG. 4 shows a side view of a video machine group of 12 units.

FIG. 4 shows a side view of a video machine tower group 50. These video units 52 generally serve as video poker video slot, video blackjack or other similar gambling machines. Their arrangement is analogous to the slot machines 22 in FIGS. 2 and 3. However, for video units 52 that do not have a play lever (i.e., are not video slot machines) it may be advantageous to use two side intakes per machine (not illustrated). Because the group has 12 rather than 8 units (as in FIGS. 2 and 3) the master duct 31 is scaled up to a cross-sectional area of about 240 square inches. Again, the master duct 31 can lead to a fan/filter unit (not shown) or to the central air conditioning-ventilation system of the casino.

Figure 5:
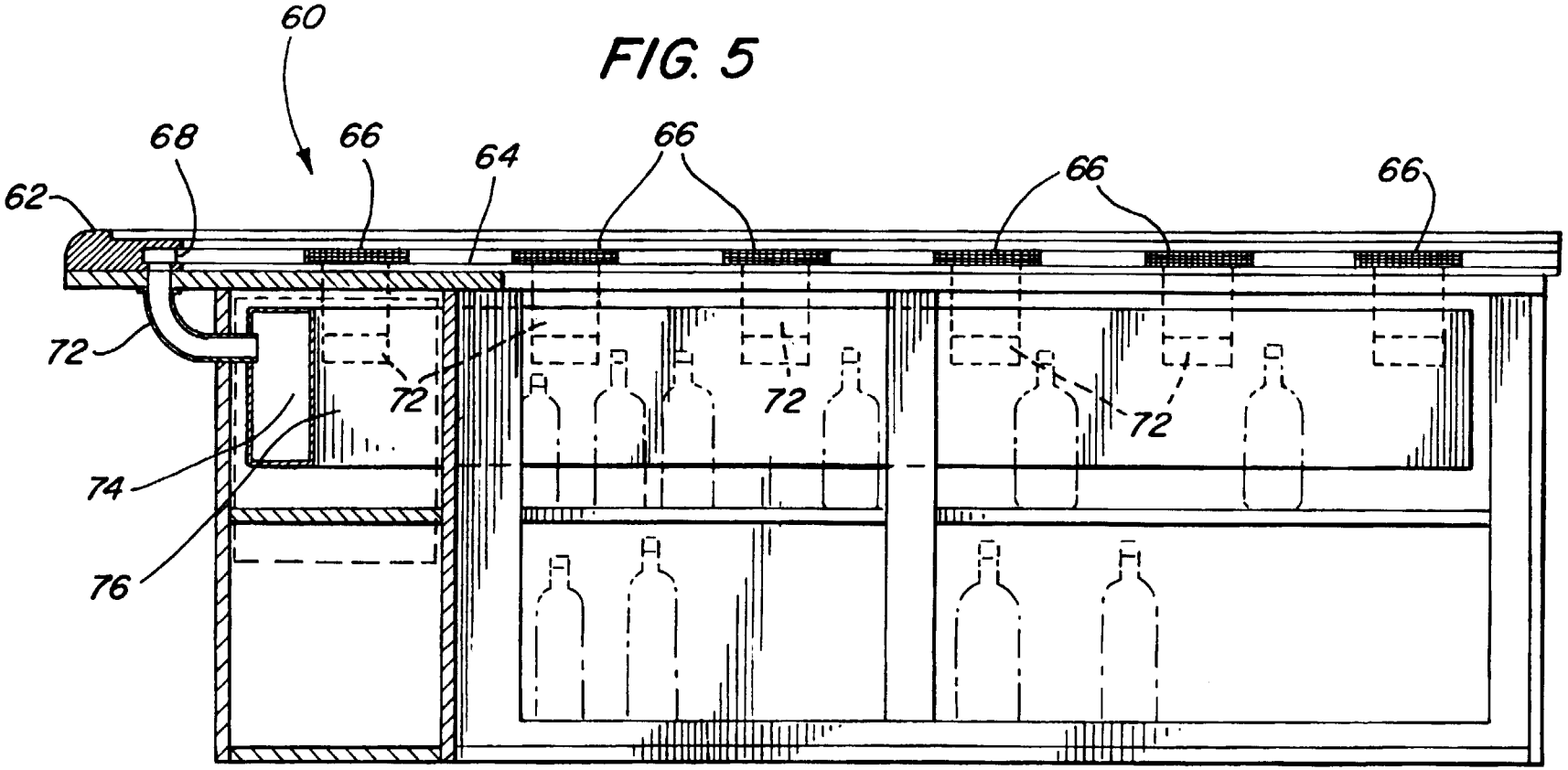
FIG. 5 shows an elevational view of the present invention at use on a twenty foot corner bar.

FIG. 5 shows the layout used for a comer twenty foot bar 60 (two ten foot sections meeting at a right angle corner). This bar configuration is useful either for a traditional beverage serving bar or a "video" bar in which video gambling units are recessed within the surface of the bar or are arranged with the video screens behind the bar (i.e., within the run area where a bartender normally stands). The bar is configured with a raised peripheral arm rest 62 elevated about 2½ inches from the bar surface 64. Each ten-foot side of the corner bar 60 has six intakes 66 with a single corner intake 68, here shown in cross section. The intakes 66, 68 are of the standard 10 square inches (5 inches×2 inches) slot configuration and are located within the raised arm rest 62 between the bar surface 64 and an upper surface of the arm rest 62. The intakes 66, 68 have grill covered openings facing away from a periphery of the bar 60 so as to catch any tobacco smoke exhaled over the bar 60. This placement is also ideal for drawing smoke from ash trays placed on the bar surface 64 or integral to the arm rest 62. As shown in FIG. 5, the intakes 66, 68 are slightly elevated above the bar surface 64 so that any spilled drinks will not be drawn in. Each intake 66, 68 is attached to a 2 inch×5 inch elbow 72 which leads to a common 5 inch×12 inch duct 74 which runs along both sides of the corner bar 60. The duct 74 leads either to a fan/filter unit (not shown) or to the central air conditioning-ventilation system of the casino.

Figure 6:
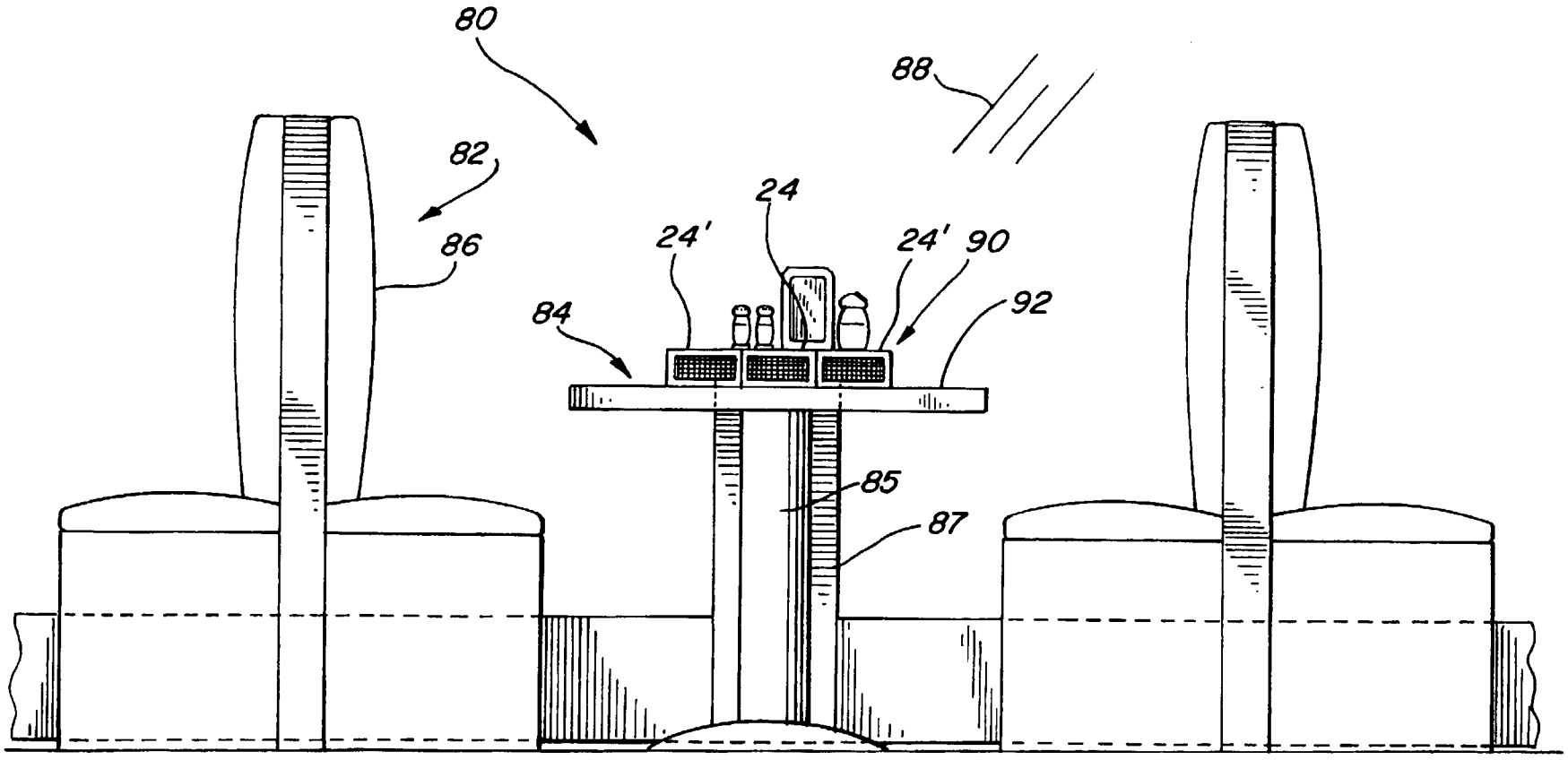
FIG. 6 shows a restaurant booth incorporating the present invention.

FIG. 6 shows an elevational view of a restaurant booth 80 that incorporates the present invention. Each booth 80 comprises two seats 82 disposed on either side of a fixed table 84. Generally several booths 80 are arranged in a row so that for a booth 80 in the middle of the row (such as shown in FIG. 6) seats 82 of adjacent booths 80 share a single back 86. The seats 82 and the table 84 with a central leg 85 are fixed in position, generally with one end of the booth 80 abutting a wall 88 while the other end remains open for ingress and egress of customers. An intake box 90 is affixed to an upper surface 92 of the table 84 and is adjacent to the wall 88. Each of the intakes 24 is covered by a screen or grill to prevent the entry of large objects. The intake box 90 contains three 5 inch×2 inch intakes 24 similar to the ones discussed already. A middle intake 24 is aimed across the table surface 92 at right angles to the wall 88 while the side intakes 24' are angled slightly to better intercept smoke exhaled by occupants of the booth 90. This configuration effectively sweeps tobacco smoke from a region ranging at least to 24 inches above the table surface. This region includes virtually all smoke exhaled by booth occupants. The middle intake 24, in particular, effectively intercepts smoke from ash trays placed on the table. The intakes 24 communicate with a duct 87 hidden within the leg 85 or within the wall 88. This duct 87 communicates with a fan/filter unit (not shown) hidden within the seat 82 or with the central air conditioning-ventilation system of the casino.

By maintaining the prescribed velocity of about 50 fpm at six inches from the intakes 24 smoke is taken in without significantly disturbing, for example, papers or other light objects on the table and without producing excessive noise. In an occupied room the background sounds will effectively mask any noise produced by the intakes 24. An additional advantage of the intake arrangement is that the exit of contaminated air through the intakes 24 generally produces a vacuum which causes freshly conditioned air from the air conditioning-ventilation system to migrate into the booth. This results in a gentle movement of fresh air without having to resort to noisy and dangerous fans and without having drafty streams of air blowing from the ventilation system.

Those skilled in the art will appreciate that various adaptations and modifications of the just-described preferred embodiment can be configured without departing from the scope and spirit of the invention. Therefore, it is to be understood that, within the scope of the appended claims the invention may be practiced other than as specifically described herein.

What is claimed is:

1. A system for removing tobacco smoke from an indoor location occupied by smokers before the tobacco smoke disperses into a bulk of the room air, the system comprising at least one slot-shaped air intake having an intake area of about ten square inches and a ratio between slot length and slot height of at least two, said slot-shaped air intake located within about two feet of a source of tobacco smoke;

an air evacuating unit for pulling smoke into the air intake, said evacuating unit configured to provide an air velocity of about 1000 to about 2000 feet per minute measured at the air intake; and conduction means for operatively connecting the air evacuating unit with the air intake.

2. The system of claim 1, wherein the air intake, the air evacuating unit, and the conduction means are selected so that air velocity measured at six inches from the air intake is about 40–60 feet per minute.

3. The system of claim 2, wherein the air velocity measured at six inches from the air intake is about 50 feet per minute.

4. The system of claim 1, wherein the air evacuating system releases evacuated air to an outside location.

5. The system of claim 1, wherein the air evacuating system releases evacuated air to an indoor location.

6. The system of claim 5, wherein the air evacuating system filters evacuated air to remove smoke before releasing it.

7. A process for removing smoke laden air from an indoor area occupied by a smoker comprising the steps of:

placing a slot-shaped air intake of about 10 square inches in area and a length at least twice as great as the height in the indoor area within about two feet of a source of smoke;

operating an air evacuating unit connected to the air intake to evacuate air from a region surrounding the air intake, the evacuating unit producing an air velocity between 1000 and 2000 feet per minute at the air intake when operating; and adjusting the air intake and the air evacuating unit so that air velocity measured six inches from the intake is between 25 and 100 feet per minute, whereby smoke is evacuated without introducing turbulence or excessive noise.

8. The process of claim 7 wherein the air velocity at six inches from the air intake is between 40 and 60 feet per minute.

9. The process of claim 7 further comprising the steps of filtering evacuated air to remove smoke and then discharging the filtered air within the indoor area.

10. A device for removing smoke from an immediate vicinity of a slot machine, comprising:

two slot-like air intakes, one positioned vertically at a side of the slot machine and one positioned horizontally above the slot machine, each intake having an intake area of about ten square inches and a length at least twice as great as the height, the intakes oriented to draw smoke from a user of the slot machine;

an air evacuator for drawing air through the air intakes providing an air velocity of between 1000 and 2000 feet per minute measured at the air intake; and conduit for connecting the air intakes to the evacuator.

11. The device of claim 10, where the horizontally positioned air intake is positioned adjacent to the mouth of the user of the slot machine and the vertically positioned air intake is positioned adjacent to a resting position of the left hand of the user of the slot machine.

12. A system for reducing tobacco smoke contamination from ambient air of the type where air intakes are placed near a source of tobacco smoke and an evacuating unit is connected to the air intakes by conduits, the improvement comprising: using slot-shaped air intakes of about ten square inches wherein the intake length is at least twice the intake height;

selecting evacuating unit power, air intake size and conduit size so that air velocity measured at the intake is between 1000 and 2000 feet per minute; and adjusting the system so that air velocity measured about six inches from the air intake is between 25 and 100 feet per minute.

* * * * *